United States Patent [19]

Craven

[11] Patent Number: 4,764,775

[45] Date of Patent: Aug. 16, 1988

[54] MULTI-MODE FEED HORN

[75] Inventor: Tyson S. Craven, Fort Lauderdale, Fla.

[73] Assignee: Hercules Defense Electronics Systems, Inc., Clearwater, Fla.

[21] Appl. No.: 719,619

[22] Filed: Apr. 1, 1985

[51] Int. Cl.[4] ..... H01Q 13/02

[52] U.S. Cl. ..... 343/786; 333/21 R; 333/125; 343/772

[58] Field of Search ..... 343/786, 781 R, 776, 343/777, 778, 779, 772; 333/21 R, 137, 125

[56] References Cited

U.S. PATENT DOCUMENTS

| | | | |
|---|---|---|---|
| 2,611,087 | 9/1952 | Alford | 343/786 |
| 2,816,271 | 12/1957 | Barker | 333/21 R |
| 3,308,469 | 3/1967 | Drabowitch | 343/786 |
| 3,530,483 | 9/1970 | Pierrot | 343/786 |
| 3,750,183 | 7/1973 | Drabowitch | 343/786 |
| 3,906,508 | 9/1975 | Foldes | 343/786 |
| 4,241,353 | 12/1980 | Salvat et al. | 343/786 |
| 4,473,828 | 9/1984 | Morz et al. | 343/786 |

*Primary Examiner*—William L. Sikes
*Assistant Examiner*—Michael C. Wimer
*Attorney, Agent, or Firm*—Seymour Levine; Michael B. Keehan; Edmund C. Ross, Jr.

[57] ABSTRACT

A linearally polarized multiport multimode feed for a reflector type antenna generates a plurality of beams, each in a different pointing direction, from a single radiating aperture. Each beam possesses a distinct phase center determined by the waveguide modes establishing the aperture distribution for that beam. The feed is linear and bilateral, therefore may be utilized in a receiving or transmitting antenna.

5 Claims, 4 Drawing Sheets

S'H
SH
L
52
72
31
71
68
69

S'E
SE
SE
L
52
31
74
76
77
78

MULTI-MODE FEED HORN

BACKGROUND OF THE INVENTION

1. Field of the Invention

The invention described herein relates generally to monopulse antennas and more particularly to parabolic reflector feed antennas for the generation of monopulse beams.

2. Description of the Prior Art

A parabolic reflector illuminated symmetrically by a primary source at the focal point will produce a symmetrical far field pattern centered along the antenna axis through the apex and focal point, referred to generally as the boresight axis. When the primary source illuminating the parabolic reflector is laterally displaced in the focal plane from the focal point F by a small distance $\Delta_X$, the phase center will remain close to the original position but the amplitude pattern will be squinted off the boresight axis at an angle of approximately $\Delta_{X/F}$. A pair of feeds spaced symmetrically from the focal point will then produce symmetrically overlapping amplitude patterns in the plane determined by the axis through the feeds offset points and boresight axis. This characteristic of parabolic reflectors is utilized in amplitude sensing monopulse systems wherein tracking information is obtained by means of fixed beams squinted off the boresight axis to establish a cross over level. In the simplest form, a two axis monopulse system employs four feeds in the focal plane of the parabolic reflector and a comparator network coupled to these feeds to obtain sum and difference beams necessary for monopulse operation. Comparison of the sum and difference patterns is then used to generate an error voltage representing the angle of arrival of the received signals.

The principle parameters of interest in a monopulse system are the gain of the sum beam, which effects the maximum range of the system and the difference pattern slope, which effects the off boresight angle sensitivity. In a four horn feed system these parameters are not independent, the sum pattern gain decreases while and the difference pattern slope increases with increasing squint angle. Generally a three to four db cross over between the patterns of adjacent feeds is a compromise selection.

Improved sum pattern gain and difference pattern slope may be achieved with a twelve element feed system suitably coupled through hybrid couplers to the sum and two difference channels of the monopulse antenna. This twelve element feed is configured with twin rows, having four elements each, along orthogonal axes in the focal plane to form a cross of elements centered about the focal point of the parabolic reflector. The four central elements of the cross are common to each axis and are used to generate the sum pattern. Two groups of four feeds about each axis are used to generate the two difference patterns. This configuration provides a greater sum pattern gain for a given difference pattern slope and a greater product of sum pattern gain and difference pattern slope than that provided by the four horn feed.

Another configuration that exhibits improved monopulse performance over the four element feed is a multihorn multimode feed system. In this system, four sectional horns of equal flare angle, are symmetrically positioned with the flare apex parallel about the focal point of a parabolic reflector. A generator of natural modes is coupled to the throat of each horn. This mode generator is coupled through a hybrid junction network to a sum channel port and two difference channel ports. Sum channel excitations produce even modes in each of the two center horns thereby providing the illumination of the parabolic reflector for the sum beam. One difference port is coupled to the mode generators to produce even mode exitations into adjacent horns and even mode exitations in a second pair of adjacent horns that have a polarity opposite that of the excitations in the first pair, thus illuminating the parabolic reflector in a manner to form a difference beam for one axis of the system. The second difference channel is coupled to the mode generators to establish odd modes and the two central horns, thereby providing an illumination function that establishes a difference beam about the second axis of the system. This multihorn, multimode feed is equivalent to an eight horn single mode system and requires the same number of hybrids to form the beams.

In the four, eight, and twelve horn systems the number of hybrids required is equal to the number of horns in the system. These configurations are complex, bulky, and do not provide independent control or isolation of the sum and difference channels.

Independent control of the sum and difference patterns and interchannel isolation may be achieved with five horn feed systems. A central horn with its phase center positioned at the focal point of the parabolic reflector with four horns equally spaced about its perimeter is independently fed to provide the illumination function for the sum pattern. The outer horns may be coupled to hybrid junctions in pairs or coupled to a hybrid junction network, depending upon the positioning of the outer horns, to provide the required monopulse difference channels. Complete isolation is achieved between all channels when the outer horns are coupled in pairs, while a gain increase for the difference channels is realized over that of the isolated channels when the four outer horns are coupled through a hybrid junction network to form the difference beam patterns. Though this system provides an isolation between the sum and difference patterns, the size of the central horn limits the cross over level of the squinted beams that are combined to form the difference pattern, thereby limiting the gain and error slopes achievable for these patterns.

SUMMARY OF THE INVENTION

A multimode feed horn constructed in accordance with the principles of the present invention includes a section of waveguide capable of supporting a multiplicity of modes that combine to establish a desired electric field distribution at one end plane of the waveguide section. These modes are coupled to a second waveguide section wherein the modes are appropriately phase shifted prior to coupling to a third waveguide section wherein the modes combine to produce an electric field distribution at a terminating plane which corresponds to the electric field distribution at the end plane of the first waveguide section. Waveguide dimensions and internal construction are selected to phase and impedance match *all* the necessary modes to reconstruct a multiplicity of electric field distributions in the end plane of the first waveguide section at the end plane of the third waveguide section. In the preferred embodiment of the invention the electric field distributions for a five horn monopulse system are transformed from one end plane to the other to provide an aperture illumination for a parabolic reflector antenna that establishes difference patterns, with desired crossover levels, with a minimum effect on the antenna gain for a signal transmitted via a port centrally coupled to the end plane of the first waveguide section and centrally reconstructed in the end plane of the third waveguide section.

DESCRIPTION OF THE PREFERRED EMBODIMENTS

Figure 1:
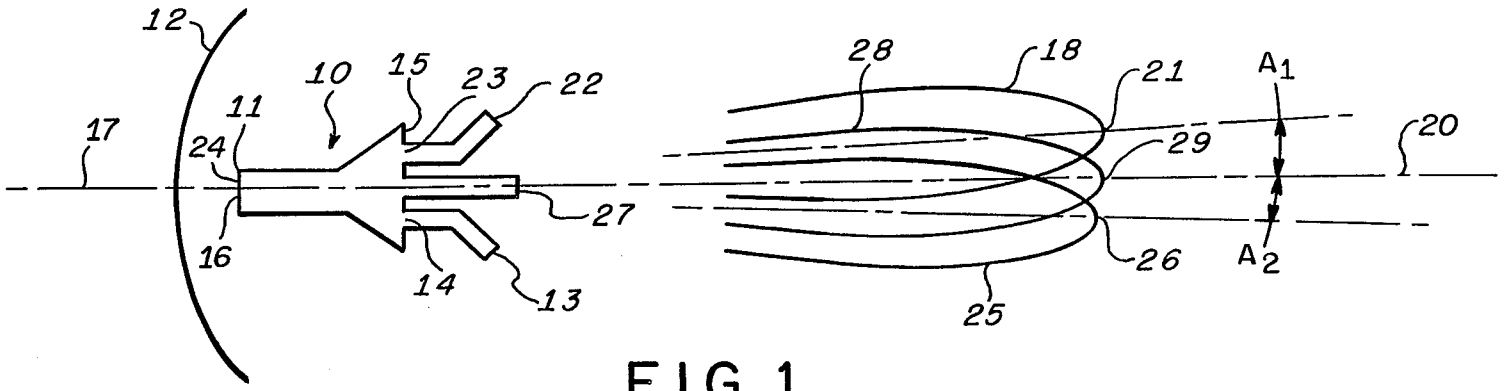
FIG. 1 is a schematic diagram of an embodiment of the invention cooperating with a parabolic reflector to produce the three radiation patterns shown in the figure.

In FIG. 1, a feed horn 10 is shown positioned with a second end plane 11 thereof in the focal plane of a parabolic reflector 12. An electromagnetic signal coupled to a waveguide 13 establishes an electric field distribution in a region 14 in a first end plane 15. The electric field distribution in the region 14 is transformed to a similar electric field distribution in the second end plane 11 in a region centered at point 16. This electric field distribution being offset from the parabolic axis 17 establishes a free space radiation pattern 18 having a peak 21 at an angle $A_1$ off the boresight line 20. Similarly, electromagnetic signals coupled to waveguide 22 establish an electric field distribution in a region 23 in the first end plane 15 of the feed system 10 which is transformed to a similar distribution in the second end plane 11 in a region centered about point 24, providing a free space antenna pattern 25 with a peak 26 offset at an angle $A_2$ from the boresight line 20. Electromagnetic signals coupled to the central waveguide 27 establish electric field distributions in the first and second end planes 15, 11, that are centered on the axis 17 thereby establishing a free space radiation pattern 28 having a peak 29 on the boresight line 20. It should be recognized that the feed system 10 is a bilateral device, and electro-magnetic waves incident to the reflector 12 will be focussed to the end plane 11 and signals coupled to waveguides 13, 22, and 27 with relative amplitudes determined by the angle of the incident wave in accordance with the radiation patterns 18, 25, and 28.

Figure 2B:
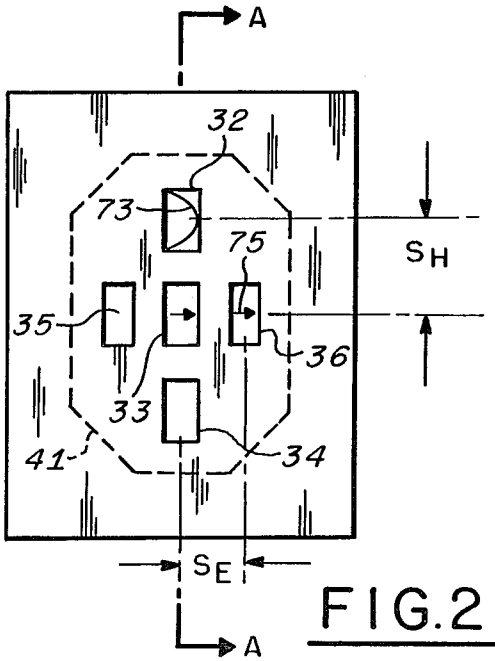
FIG. 2B is an end view of an embodiment, the invention with waveguide coupling ports indicated thereon.
Figure 2A:
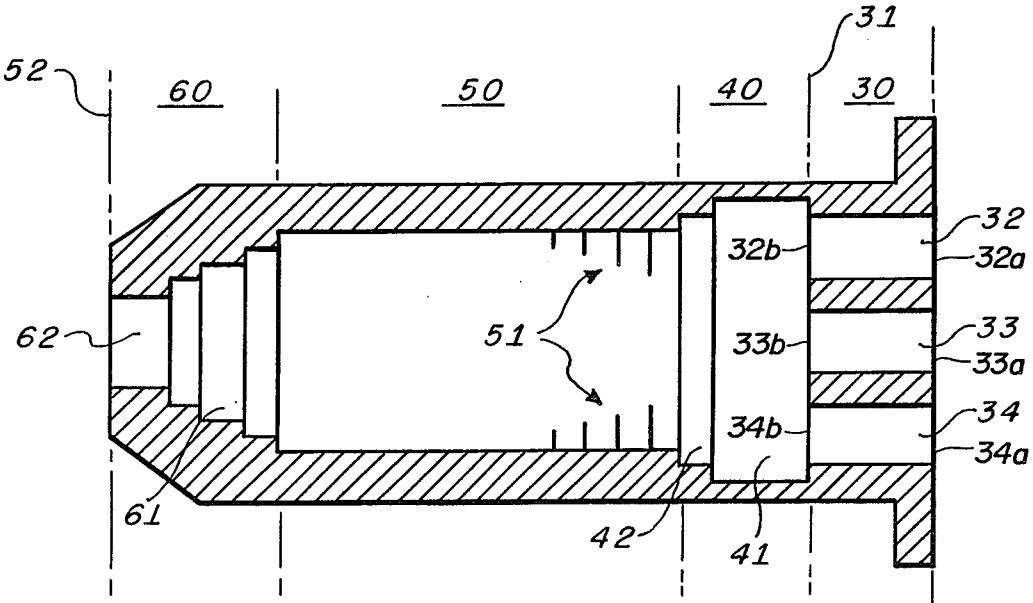
FIG. 2A is a cross sectional view of an embodiment of the invention.

Refer now to FIG. 2A, a cross sectional view of the multimode feed taken through the section A—A of FIG. 2B. A flange section 30 provides coupling for external waveguides to the first end plane 31 via flange waveguide sections 32, 33, and 34 having ports **32*a*, 33*a*, and 34*a* respectively, at one end and ports 32*b*, 33*b*, and 34*b* at the other end. The signals coupled to the end section by these waveguides establish electrical field distributions at this plane of the second ports that are reconverted to a multiplicity of propagating and non-propagating modes in a first mode conversion section 40 having receiving locations in a plane abutting end plane 31 that correspond to the ports 32*b*, 33*b*, and 34*b*. A first chamber 41 of the mode conversion section 40 is dimensioned for the propagation of preferred modes, which in the preferred embodiment are the $TE_{10}$, $TE_{20}$, and $EM_{11}$. Chamber 41 is hexagonally shaped, as shown in FIG. 2B to specifically suppress the $EM_{12}$ mode. The desired modes plus additional undesired modes, such as the $TE_{30}$ mode propagate in the chamber 41 to a matching chamber 42, designed to provide an impedance match for the $TE_{10}$ mode between the first mode conversion chamber 41 and a phase matching section 50. Designing the matching chamber 42 to provide an impedance match for the $TE_{10}$ mode between the first mode conversion chamber 41 and the phase matching section 50** concomitantly establishes acceptable impedance matches between these two elements for the $EM_{11}$ and $TE_{20}$ modes.

The higher order modes, with the exception of the $TE_{30}$ mode, are rapidly attenuated to substantial elimination in the first conversion chamber 41 and the matching chamber 42. The $TE_{30}$ mode and the desired modes are coupled from the matching chamber 42 to the phase matching chamber 50. Irises 51 are positioned in a phase matching section 50 adjacent to the impedance matching chamber 42 to suppress the $TE_{30}$ mode.

The three modes of primary interest propagate with unequal phase velocities in all sections of the feed system. The length and cross sectional dimensions of the phase matching section 50 are chosen to compensate for the differential phase shifts between these modes resulting from the propagation in all the other sections of the feed system to establish an in-phase condition for these miodes at a second end plane 52.

Propagation through the waveguide sections of the multimode feed 10, other than the phase matching section 50, causes a phase shift $\theta_{MN}$ for each mode, relative to the phase shift $\theta_O$ caused by the propagation through an equal distance in free space, that is given by:

$$\theta_{MN}=\theta_O+\Delta_{MN}$$

where $\Delta_{MN}$ may be determined by calculation or measurement. Modal phase shifts due to propagation through a waveguide may be determined from the equation:

$$\theta_{MN} = \pi l\sqrt{\frac{4\epsilon r}{\lambda_O^2} - \left[\left(\frac{m}{a}\right)^2 + \left(\frac{n}{b}\right)^2\right]}$$

where $\epsilon_R$ is the relative dielectric constant of the propagation medium, $\lambda_O$ is the free space wavelength, and "a", "b" are the cross sectional dimensions and "l" is the length of the waveguide. The three modes of interest will be of equal phase after propagating through the entire multimode feed 10 when:

$$\theta_{10}=\theta'_{10}=\theta_{20}+\theta'_{20}=\theta_{11}+\theta'_{11}$$

$$\Delta_{10}+\theta'_{10}=\Delta_{20}+\theta'_{20}=\Delta_{11}+\theta'_{11}$$

where $\theta'_{MN}$ is the modal phase shift through the phase matching section 50. These conditions may be satisfied with the proper selection of the dimensions "a", "b" and "l" for the phase matching section 50.

A second mode conversion section 60 is coupled between the phase matching section 50 and the second end plane 52, whereat the electric field distribution transformed from the first end plane 31 is established. This second mode conversion section 60 includes a three step impedance transformer 61 and a mode combining chamber 62, which cooperate to establish the desired electric field distribution at the second end plane 52. The matching transformer 61 provides an impedance match between the phase matching section 50 and the mode combining chamber 62 for the $TE_{10}$ mode. This match, like the match provided by the matching chamber 42, provides an adequate impedance match for the other modes required to form the transformed electric field distribution at the second end plane 52.

Figures 3A, 3B, 3C, 3D:
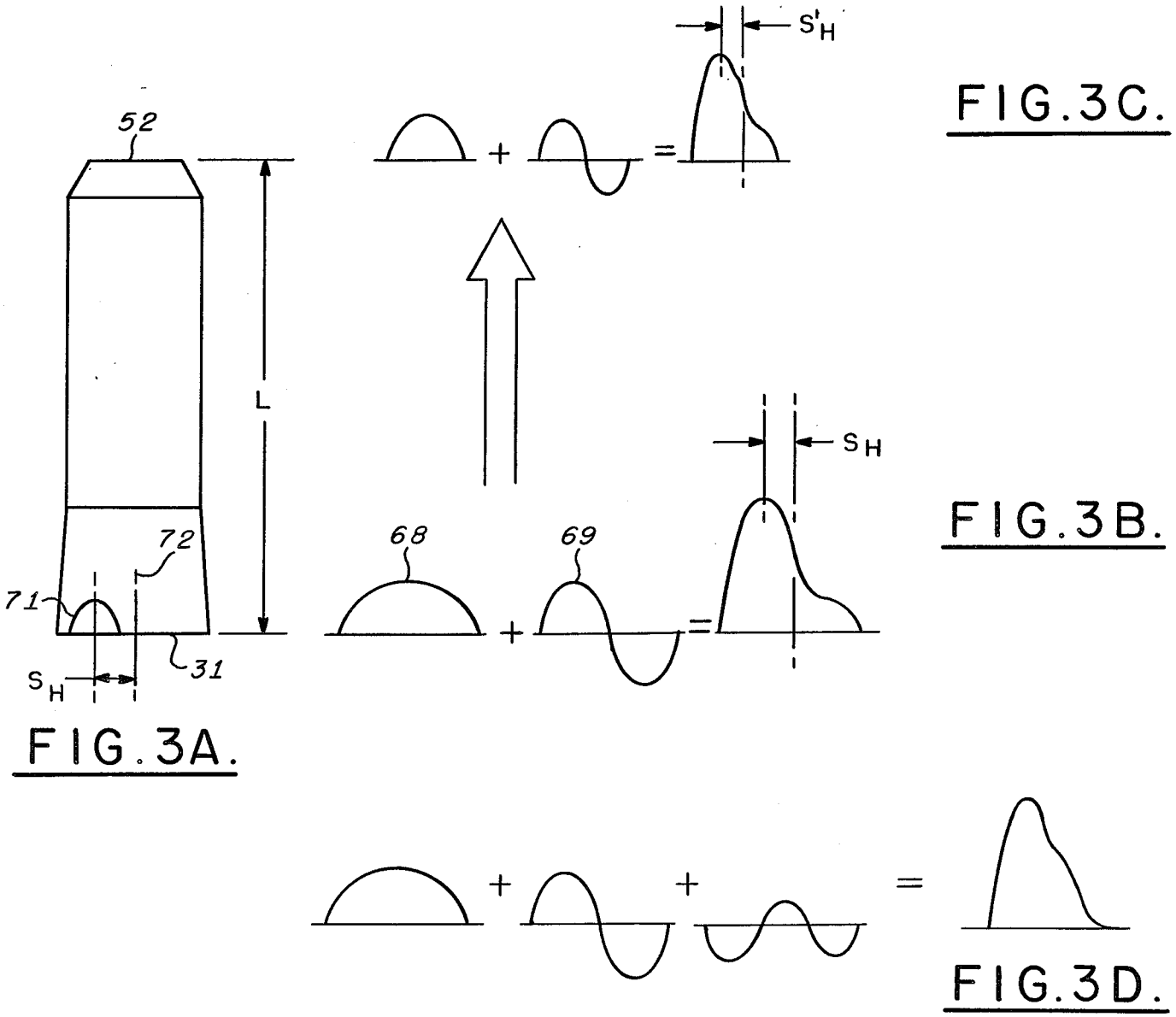
FIG. 3A is an outline drawing of an embodiment of the invention indicating thereon an H-plane offset electric field distribution in an end plane of the apparatus.
FIGS. 3B, 3C, and 3D illustrate mode generation, mode propagation, and mode combining in the H-plane of an embodiment of the invention.

Refer now to FIG. 3A wherein an electric field distribution 71 in the first end plane 31 is shown offset in the H plane from the axis of symmetry 72 by a distance $S_H$. This distribution is representative of the H plane distribution 73 coupled to the end plane 31 from the wave guide 32 as shown in FIG. 2B and may be approximated by the inphase addition of $TE_{10}$ mode 68 and $TE_{20}$ mode 69 in the end plane 31 as shown in FIG. 3B. If these modes are phase matched, as previously described over the distance L between the first end plane 31 and the second end plane 52, the modes will recombine at the second end plane 52 in a region corresponding to the receiving location of the mode conversion section 40 wherein the distribution 71 is established to provide a similar total distribution with a peak offset in the H plane $S'_H$ that is proportional to original offset $S_H$ as shown in FIG. 3C. A better approximation to the electric field distribution in the end plane 31 may be obtained by subtracting the $TE_{30}$ mode with appropriate amplitude as shown in FIG. 3D. In order to transform this better representation of the distribution from the end plane 31 to the end plane 52 it is necessary to phase match the three modes over the distance L. This is a much more difficult task than phase matching only two modes and many applications do not warrant the additional effort and increased cost of the final device caused by including the $TE_{30}$ mode.

Methods for determining the modal composition of a transverse electric field distribution are presented in numerous sources, as for example N. Marcuvitz, "Waveguide Handbook", Radiation Laboratory Series, McGraw-Hill Book Company, Inc., 1951, Chapters 1 and 2.

Figures 4A, 4B, 4C:
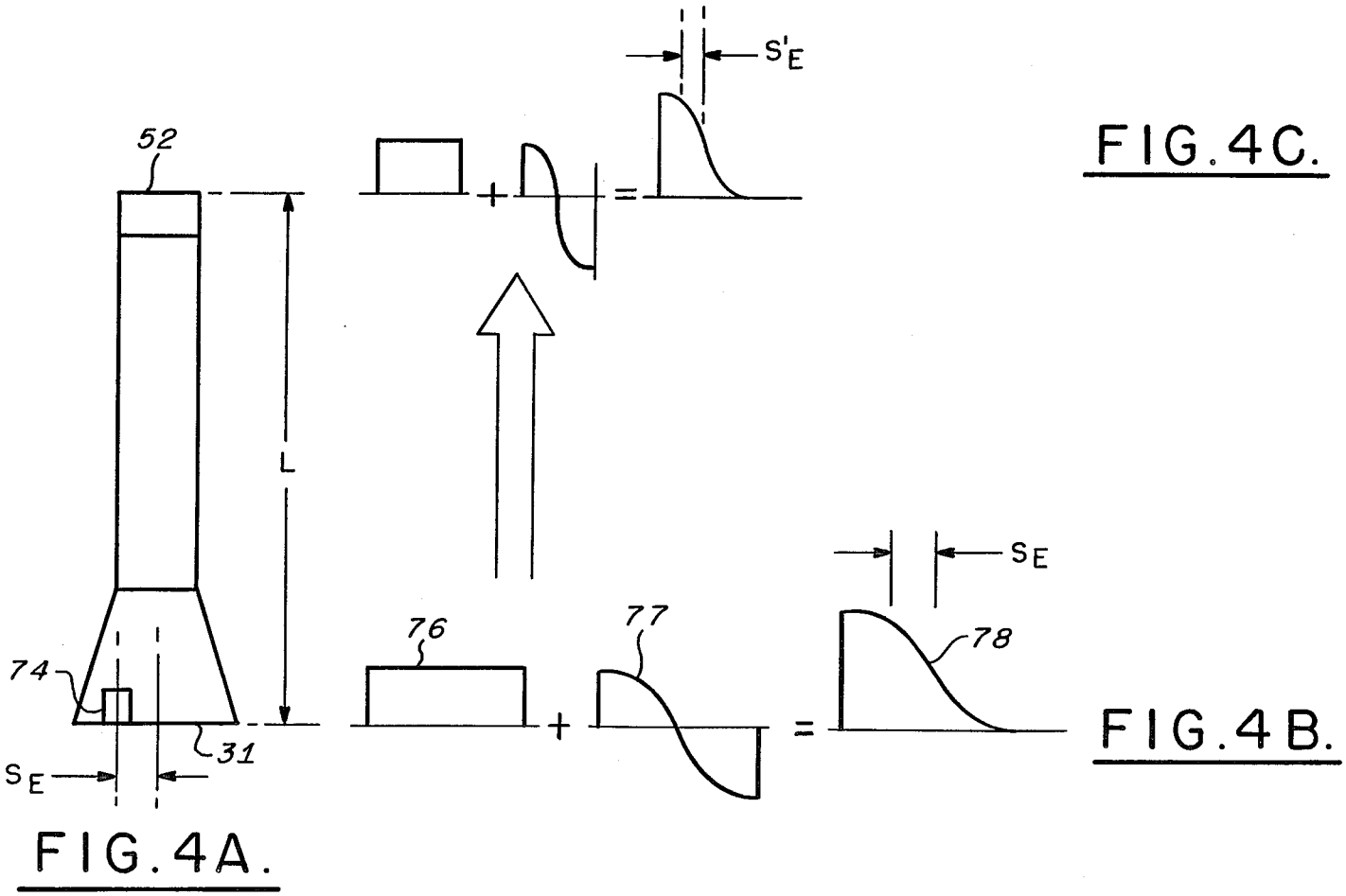
FIG. 4A is an outline drawing of an embodiment of the invention indicating thereon an E-plane offset electric field distribution.
FIGS. 4B and 4C illustrate mode generation, mode propagation, and mode combining in the E plane for the offset distribution shown in FIG. 4A.

In FIG. 4A is shown an E plane electric field distribution 74 in the end plane 31, representative of the E plane electric field distribution 75 coupled from the waveguide 36 in FIG. 2B. This distribution is formed at plane 31 by the in-phase addition of the $TE_{10}$ mode 76 and the $EM_{11}$ mode 77, which is the sum of the $TE_{11}+TM_{11}$ modes, plus higher order modes which are cut off in the mode generating chamber 41 (FIG. 2A). The $TE_{10}$ and $EM_{11}$ modes provide an approximation to the distribution 74, such as the distribution 78 shown in FIG. 4B. The modes 76, 77 propagate from the end plane 31 through the multimode feed device to the second end plane 52 whereat an in-phase addition occurs to produce the transform distribution 79 with an offset equal to $S'_E$.

Figures 5A, 5B, 5C, 6A, 6B, 6C:
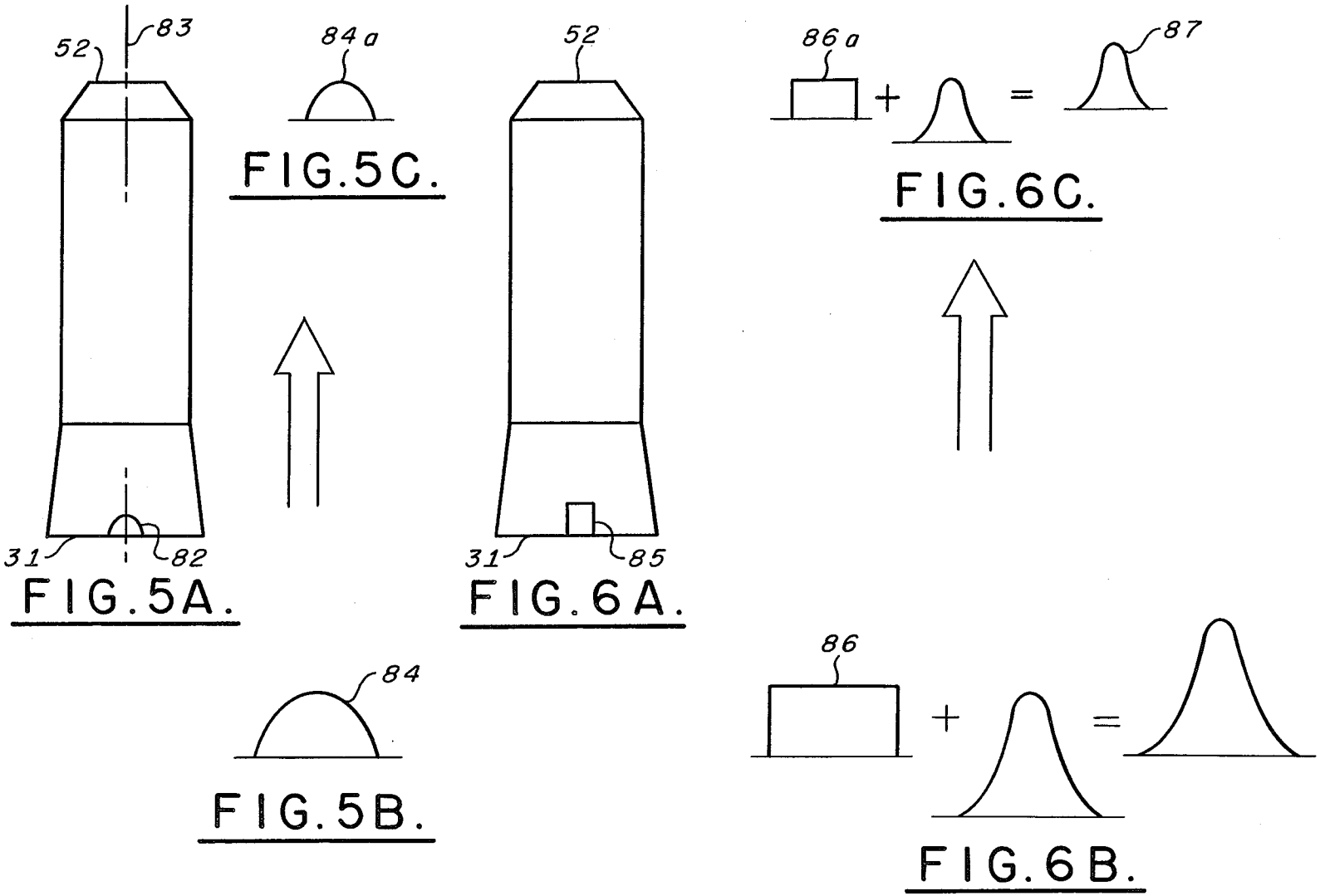
FIG. 5A is an outline drawing of a preferred embodiment of the invention indicating thereon a centrally positioned H-plane electric field distribution.
FIGS. 5B and 5C illustrate mode generation, mode propagation, and mode combining for electric field distribution of FIG. 5A.
FIG. 6A is an outline drawing of a preferred embodiment of the invention indicating thereon a centrally positioned E-plane distribution.
FIGS. 6B and 6C illustrate mode generation, mode propagation, and mode combining for converting the distribution of FIG. 6A to a more desirable distribution.

In a similar manner the electric field distribution 82 shown in FIG. 5A, established at the end plane 31 from a wave propagating in the central waveguide 33 is transformed to an electric field distribution at the second end plane 52 that is symmetrically positioned about the axis 83 of the multimode feed. The symmetrically positioned H plane distribution 82 comprises the $TE_{10}$ mode 84, $TE_{30}$ mode and higher order modes in the mode generating chamber 41. As previously stated the $TE_{30}$ mode is not phase matched in the phase matching section and is suppressed by the mode suppressor 51. Since the higher order modes do not propagate in the phase matching section the $TE_{10}$ mode is transformed to the end plane 52 to establish an electric field distribution **84*a* representative of the electric field distribution 82 at the end plane 31. This distribution covers the entire aperture at the end plane 52** which is of a dimension to provide the desired illumination of a parabolic reflector from the focal region thereof.

As shown in FIG. 6A the E plane distribution 85 at the end plane 31 established by a wave in the central waveguide 33 is uniform over the extent of the waveguide in the E plane. This E plane distribution may be represented by the $TE_{10}$ mode 86 which, if not combined with other modes, establishes a uniform distribution **86*a* in the E plane of the aperature at the end plane 52. This uniform distribution causes a relatively narrow beam to radiate from the feed 10, thus providing an inefficient illumination from the focal region of a parabolic reflector that transforms into a secondary pattern with a relatively broad beamwidth. To provide greater illumination efficiency the radiation pattern from the multimode feed must be broadened. This may be accomplished by tapering the aperature illumination at the end plane 52. Though the $EM_{12}$ mode is suppressed at the end plane 31 in the regions of waveguides 32, 34, 35, and 36 by the beveling of the mode generating chamber, the $EM_{12}$ mode coupled at the aperature of the central waveguide 33 propagates in the multimode feed and is phase matched to the $TE_{10}$ mode in the phase matching section 50. Though the impedance matching section 60 is designed to match the $TE_{10}$ mode, an approximate match to the $EM_{12}$ results and two modes combine at the aperture 62 in the end plane 52 to form the tapered distribution 87 as shown in FIG. 6C. The tapered distribution 87** causes a broader beam to radiate from the multimode feed for the illumination of the parabolic reflector, thereby providing a more efficient aperture illumination to generate a more narrow secondary radiation pattern in the E plane of the antenna.

While the invention has been described in its preferred embodiments, it is to be understood that the words which have been used are words of description rather than limitation and that changes may be made within the purview of the appended claims without departing from the true scope and spirit of the invention in its broader aspects.

I claim:

1. A multimode feed horn comprising:

flange means having a plurality of waveguide sections each having first and second ports, said first ports positioned to be coplanar in a first waveguide end plane and said second ports positioned to be coplanar in a second waveguide end plane for propagating one mode of wave energy in each waveguide section between said first and second ports;

mode conversion means having receiving locations in a first end plane coupled respectively to said second ports for converting a mode received at a receiving location into component modes capable of propagating in said mode conversion means, said component modes being determined by said receiving locations in said first end plane;

phase matching means coupled to said mode conversion means constructed to propagate said component modes, and having a mode suppressor therein to suppress at least one of said component modes, for phase matching at least two of said component modes, thereby providing at least two phase matched modes at an output plane of said phase matching means; and combining means coupled to receive said at least two phase matched modes and having regions in a second end plane each uniquely corresponding to a receiving location in said first end plane, for combining said at least two modes and providing a mode at a region in said second end plane corresponding to said mode at said corresponding receiving location.

2. A multimode feed in accordance with claim 1 wherein said mode conversion means has a central axis and is constructed to suppress $EM_{12}$ modes generated at receiving locations not centered at said central axis.

3. A multimode feed in accordance with claim 1 wherein said mode suppressor is constructed to suppress $TE_{30}$ modes.

4. A multimode feed in accordance with claim 1 wherein said mode conversion means and said combining means include means for impedance matching at least one component mode to said phase matching means.

5. A multimode feed horn comprising:

flange means having a plurality of waveguide sections each having first and second ports, said first ports positioned to be coplanar in a first waveguide end plane and said second ports positioned to be coplanar in a second waveguide end plane for propagating one mode of wave energy in each waveguide section between said first and second ports;

mode conversion means constructed to provide an octagonal cross section having receiving locations in a first end plane coupled respectively to said second ports for converting a mode received at a receiving location into component modes capable of propagating in said mode conversion means, said component modes being determined by said receiving locations in said first end plane, said mode conversion means having a receiving axis and further constructed to suppress $EM_{12}$ modes generated at receiving locations not centered at said central axis;

phase matching means coupled to said mode conversion means constructed to propagate said component modes, and having a mode suppressor therein to suppress at least one of said component modes, for phase matching at least two of said component modes, thereby providing at least two phase matched modes at an output plane of said phase matching means; and combining means coupled to receive said at least two phase matched modes and having regions in a second end plane each uniquely corresponding to a receiving location in said first end plane, for combining said at least two modes and providing a mode at a region in said second end plane corresponding to said mode at said corresponding receiving location.

* * * * *